United States Patent [19]

Lucas

[11] Patent Number: 4,844,269

[45] Date of Patent: Jul. 4, 1989

[54] PACKING DEVICE OF AN OVAL SHAPE IN CROSS-SECTION, AND COMPRISING A CAP OF A SAME SHAPE TO BE FIXED IN A TIGHT MANNER TO THE PACKING DEVICE

[76] Inventor: Marthe Lucas, 16 rue du Puits des Esquilles, 34000 Montpellier, Hérault, France

[21] Appl. No.: 109,202

[22] Filed: Oct. 16, 1987

[30] Foreign Application Priority Data

Oct. 16, 1986 [FR] France ..... 86 14369
Oct. 9, 1987 [FR] France ..... 87 13989

[51] Int. Cl.[4] ..... B65D 41/04; B65D 41/34

[52] U.S. Cl. ..... 215/331; 215/340; 215/341

[58] Field of Search ..... 215/295, 329, 331, 340, 215/341, 344

[56] References Cited

U.S. PATENT DOCUMENTS

| | | | |
|---|---|---|---|
| 574,379 | 1/1897 | Bouneu | 215/329 |
| 1,316,746 | 9/1918 | Shiga | 215/340 X |
| 2,981,968 | 5/1961 | Schaich | 215/340 X |
| 3,259,935 | 7/1966 | Miller | 215/340 X |
| 3,828,962 | 8/1974 | Atkins | 215/295 X |
| 3,860,152 | 1/1975 | Marti | 215/295 X |
| 4,006,837 | 2/1977 | Gates et al. | 215/340 |
| 4,051,974 | 10/1977 | Gentile | 215/329 |
| 4,266,682 | 5/1981 | Speitel et al. | 215/331 |
| 4,310,101 | 1/1982 | Sekine | 215/331 X |
| 4,691,833 | 9/1987 | Ahrens | 215/331 X |

*Primary Examiner*—Stephen Marcus
*Assistant Examiner*—Nova Stucker
*Attorney, Agent, or Firm*—Browdy and Neimark

[57] ABSTRACT

The packing device has a cap insidely containing a cover provided with a seal corresponding to a bearing surface of the body of the packing device. The body forming lateral studs cooperates with protruding bearing surfaces formed by lugs defined by the cap.

18 Claims, 3 Drawing Sheets

PACKING DEVICE OF AN OVAL SHAPE IN CROSS-SECTION, AND COMPRISING A CAP OF A SAME SHAPE TO BE FIXED IN A TIGHT MANNER TO THE PACKING DEVICE

FIELD OF THE INVENTION

The present invention relates to packing devices having an oval or approximately oval shape in cross-section and which include a cap which has to be easily removed from the packing device while providing perfect tightness with the body of the packing device supporting it, whereby the product contained therein is maintained sheltered from the atmosphere.

Packing devices of this shape are used in particular in the field of perfumery and pharmacy, but until now their tightness is not perfect because sealing was only provided by rubbing seals. Actually, the oval shape of both the body and the cap of the packing device is such that closing is provided by merely sliding the cap with respect to the body.

The present invention provides a new packing device of a general oval shape, ensuring the tightness by means of a seal maintained under pressure.

The packing device of the invention is applicable in a particularly interesting manner for containing cosmetics and similar products which have to be protected against oxidation due to exposure to air and which may soil clothing or the inside of a bag upon leaking from the packing container.

SUMMARY OF THE INVENTION

According to the invention, the oval-shaped packing device which has to be closed in a tight manner comprises a body and a cap, the cap containing a cover inside thereof provided with a seal corresponding to a bearing surface of the body, this body forming lateral studs cooperating with protruding bearing surface formed by lugs defined by the cap, whereby the seal is compressed onto the bearing surface when the protruding bearing surface is retained by the studs.

Various other features of the invention will become more apparent from the hereafter detailed description.

BRIEF DESCRIPTION OF THE DRAWINGS

Embodiments of the invention are shown by way of non limiting examples in the accompanying drawings, wherein.

DESCRIPTION OF PREFERRED EMBODIMENTS

Figure 2:
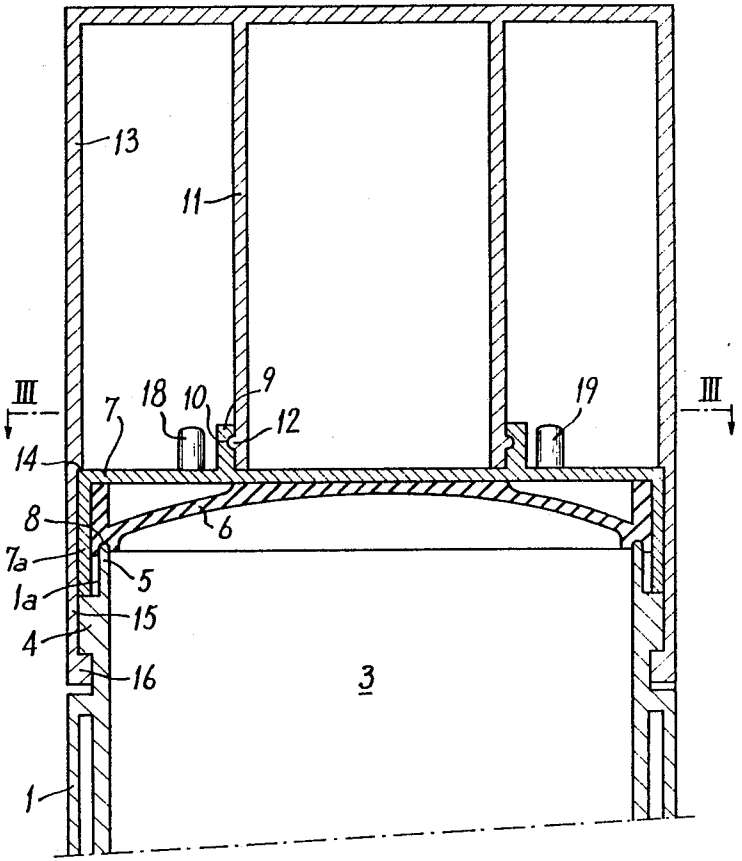
FIG. 2 is a partial elevation cross-sectional view substantially taken in the axial direction of the device of FIG. 1.
Figure 1:
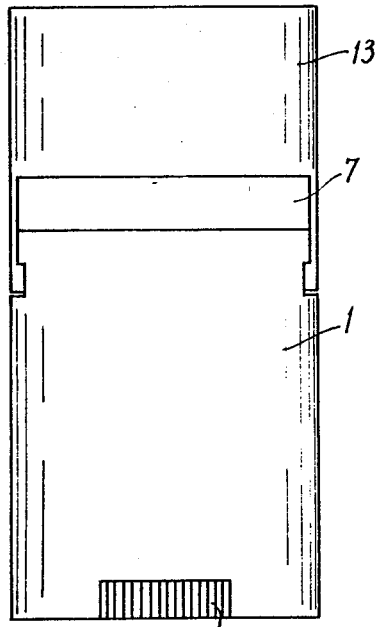
FIG. 1 is a side elevation view of the packing device of the invention.

The packing device to which the invention applies includes a body 1 for containing various products, for example a cosmetic product, and the body 1 can be associated with a control means 2, for example a knurled knob, for axially displacing a product 3 (FIG. 2) which can be make-up, a lipstick, a deodorant product or other similar products.

Figure 3:
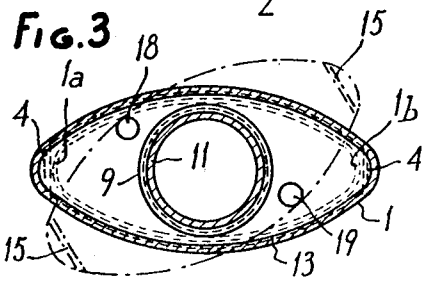
FIG. 3 is a sectional view taken along line III—III of FIG. 2.

The body 1 is formed to have a cross-section which is substantially oval as illustrated in FIG. 3 and is formed, at least in its upper portion, with portions 1*a*, 1*b* from which protrude studs 4 the function of which is explained thereafter. The upper portion of the body 1 forms also a bearing surface 5 for a seal 6 which is encased inside a cover 7.

The drawings shown that the seal 6 defines advantageously a groove 8 surrounding the bearing surface 5 of the body 1.

Moreover, the drawings show that the cover 7 comprises a turned down edge 7*a* acting as a holding element for the seal 6 and bearing against the studs 4 when the body 1 is closed by the cover.

The cover 7 has the same oval shape as the body 1 but can be realized in a different material or at least in a different color when it is desired that the packing has a particular appearance.

The top of the cover 7 is formed with a joining piece 9 with an inner groove 10. The joining piece 9 forms a tubular member for a tubular portion 11 having a circular section, with an outer diameter corresponding to the inner diameter of the joining piece 9.

The tubular portion 11 is formed with a retaining ridge 12 or other latching projections to be forcibly introduced inside an inner groove 10 provided in the joining piece 9.

The tubular portion 11 is formed integrally a unit with a cap 13 having an outer wall which is of an oval cross-section for corresponding exactly to the body 1 and so as to be flush with the body 1.

In a similar way as for the cover 7, the cap 13 can be made of material different to that of the body 1, or have another color or a different texture.

In order to provide a good connection between the cover 7 and the cap 13, the cap 13 is advantageously formed with a shoulder 14 against which the top of the cover 7 will abut when the tubular portion 11 is latched inside the joining piece 9 via the retaining ridge 12.

At its base, the cap 13 defines two diametrically opposite lugs 15 having at their base protruding portions 16 corresponding to the bottom portion of the studs 4 formed by the body 1.

Figure 4:
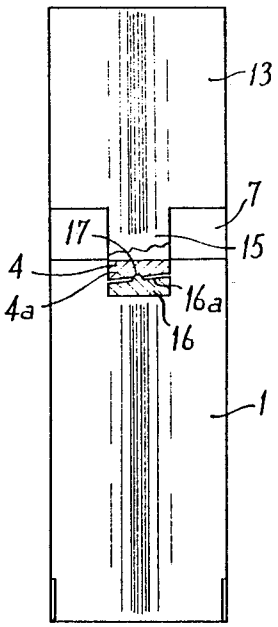
FIG. 4 is an elevation view partially broken away corresponding to FIG. 1 but rotated about 90° with respect to FIG. 4.

FIG. 4 shows that the studs 4 and the protruding portions 16 define matching ramps 4*a*, 16*a* and preferably also a latching protrusion 17.

In addition to the hereabove features, abutments 18, 19 are formed on top of the cover 17 and are disposed in such a manner that the inner wall of the cap 13 will bear against the abutments 18, 19 when the cap 13 is rotated about a certain angle with respect to the body 1, this angle being at least equal to that providing for disengagement of the protruding bearing surfaces 16 from the studs 4.

In practice, the above rotation angle can be in the order of 30° to 45°.

When the various parts have been manufactured, the seal 6 is enclosed inside the cover 7, then the cover 7 is itself engaged between the lugs 15 of the cap 13 up to the moment when the tubular portion 11 is latched inside the joining piece 10.

In order to put the cap 13 in position, it is presented as shown in FIG. 3 so that it forms an angle with respect to the body 1 so that the latching protrusions 17 are angularly off-set with respect to the studs 4.

FIG. 3 shows that the abutments 18, 19 permit a guiding of the cap 13 with respect to the body 1 in order to have a correct presentation of the cap 13 with respect to body 1.

The cap 13 is then rotated with respect to the body 1 so that the protruding bearing surfaces 16 are engaged underneath the studs 4, the matching ramps 4*a*, 16*a* assisting in clamping the cap 13 onto the body 1.

The effect of the clamping action is to strongly apply the seal 6, and particularly its groove 8, against the bearing surface 5 of the body 1, thereby providing complete tightness between the body 1 and cover 7 and, consequently, an isolation of the product contained therein from the ambient atmosphere.

When the cap 13 is made of a synthetic resin having a certain degree of flexibility, it is also possible to put the cap 13 and the cover 7 in position by a simple sliding motion, the lugs 15 being resiliently deformed as the lugs 15 run over the studs 4.

In order to have an access to the product contained in the body 1, it suffices to slightly rotate the cap 13 with respect to the body 1 in order to bring it to the position shown in phantom line in FIG. 3, the effect of which it to disengage the protruding bearing surfaces 16 from the studs 4 and then to permit an extraction of the cap 13 from the cover 7 and from its seal by a simple axial sliding motion of the cap 13 with respect to the body 1 without deteriorating the product contained therein.

According to another embodiment of the invention, the body 1 has a bearing portion 5 for a seal 6 which forms also the cover for the body 1 while housing the bearing portion 5. The seal 6 is covered by the cap 13 to which it is connected by any appropriate means, for example by snap-in members.

Figure 17:
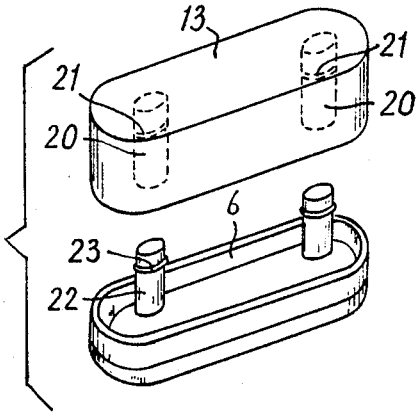
FIG. 17 is a perspective view illustrating a detail of a junction of two parts of the device of the invention.

FIG. 17 shows that the cap 13 can be provided inside with sockets 20 having a collar 21, and that the seal 6 can be provided with corresponding fingers 22 with a retaining ring 23. By engaging the seal 6 inside the cap 13, the retaining rings 23 of the fingers 22 are latched by the collars 21 inside the sockets 20, thereby fixedly joining the two parts together.

Figure 5:
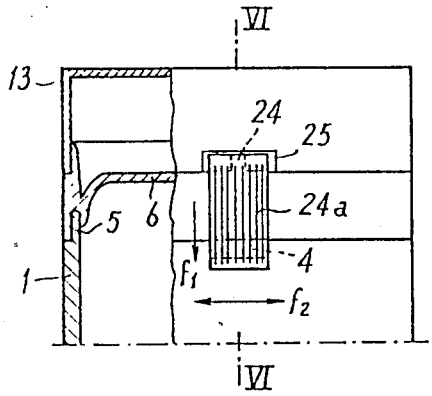
FIG. 5 is an elevation cross-sectional view illustrating a first embodiment of the packing device of the invention.
Figure 6:
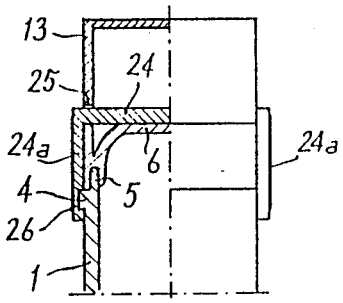
FIG. 6 is a cross-sectional view taken along line VI—VI of FIG. 5.
Figure 7:
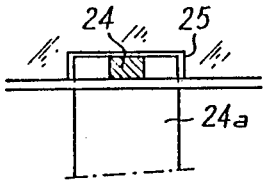
FIG. 7 is a diagrammatic cross-sectional view illustrating a detail of embodiment.

In FIGS. 5 to 7, a stirrup 24 is placed via its transverse arm, preferably of a small width, in an opening 25 of the cap 13 and, possibly, of the seal 6. Arms 24*a* of the stirrup 24 bear against flanks of the seal 6 and of the body 1 and are formed with a snap-in groove 26 for each of the studs 4 of the body 1. The bottom portion of the studs 4 is advantageously buldging, the effect of which is to displace the stirrup 24 in direction of the arrow f1 when it covers the stud, and consequently to clamp the seal 6 on the bearing surface 5 of the body 1. In order to disengage the cap 13, it suffices to displace the stirrup 24 in either direction of the arrow f2 in order to free the studs 4.

Figure 8:
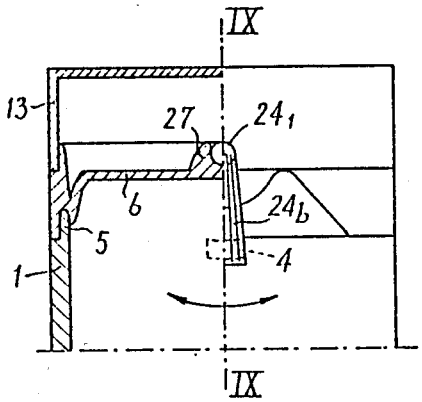
FIG. 8 is an elevation view, partly in cross-section, illustrating a variant.
Figure 9:
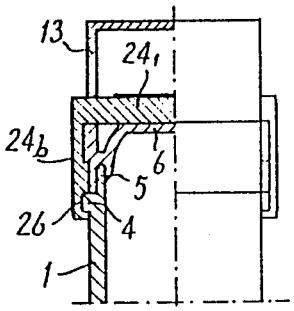
FIG. 9 is a cross-sectional view taken along line IX—IX of FIG. 8.

In FIGS. 8 and 9, the seal 6 forms a cradle 27, and the arms 24*b* of the stirrup 24 are latched by a pin $24_1$ maintained inside the cradle 27. In this embodiment, the cap 13 is slotted in order to encase the pin $24_1$. By rotating, the arms 24*b* of the stirrup 24, the arms 24*b* will escape from the studs 4, whereby the opening of the body 1 is possible.

Figure 10:
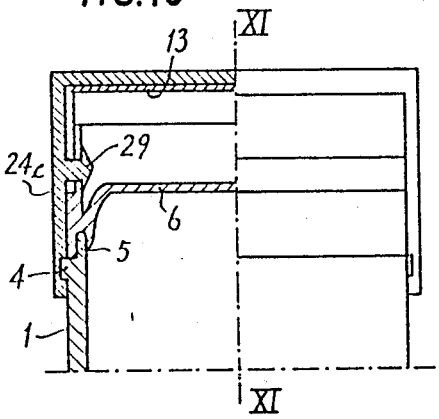
FIG. 10 is a cross-sectional view of another variant.
Figure 11:
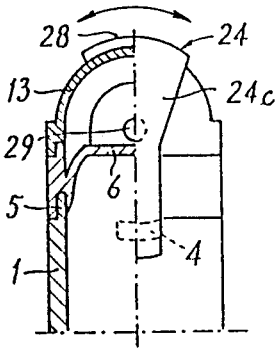
FIG. 11 is a cross-sectional view taken along line XI—XI of FIG. 10.

In FIGS. 10 and 11, the top of the cap 13 is formed substantially in the shape of a cylinder and is partially covered by a cylindrical sector 28 formed by the stirrup 24, and the arms 24*c* of the stirrup 24 are articulated on pins 29 engaged inside holes of the seal 6 and the cap 13. As in the previous embodiment, the end of the arms 24*c* of the stirrup 24 cooperate with a stud 4 of the body 1. In order to disengage the cap 13, its suffices to tip the stirrup 24 in either direction, whereby the arms 24*c* of the stirrup 24 can free the studs 4. The device is advantageously made of a relatively rigid resin for the stirrup 24, for example polystyrene, and flexible resins for the cap 13 and seal 6, for example polyethylene.

Figure 12:
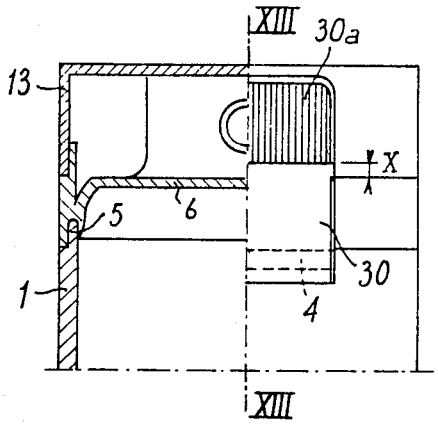
FIG. 12 is an elevation cross-sectional view showing still another variant.
Figure 13:
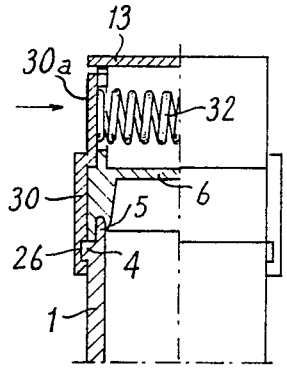
FIG. 13 is a cross-sectional view taken along line XIII—XIII of FIG. 12.
Figure 14:
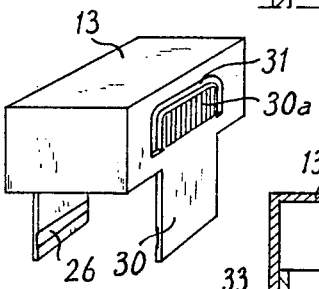
FIG. 14 is a perspective view illustrating a detail of embodiment.

In FIGS. 12 to 14, the cap 13 forms side lugs 30 having an upper portion 30*a* which protrudes from the bottom portion of a housing 31, so that the lugs 30 can slightly pivot.

As in the previous embodiments, the lugs 30 which are in some way similar to the above described stirrup arms are formed with a snap-in groove 26 for each stud 4 of the body 1. If the resiliency of the constituent material of the cap 13 is not sufficient, a resilient element 32 is provided for bearing against the flanks of the upper portion 30*a* of the lugs 30, possibly via portions of the seal 6.

Figure 15:
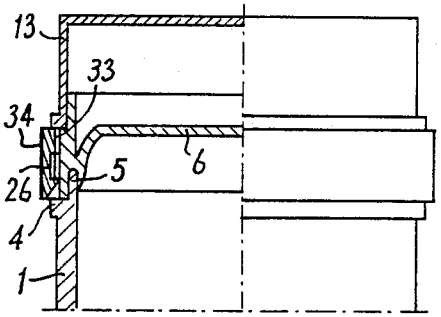
FIG. 15 is a cross-sectional view of another variant.
Figure 16:
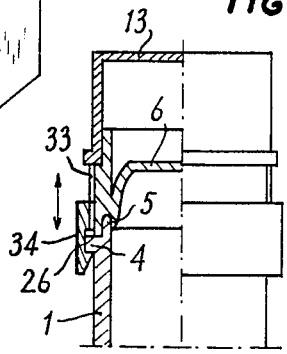
FIG. 16 is a half cross-sectional view illustrating a characteristic position.

The variant of FIGS. 15 and 16 illustrates an embodiment according to which the cap 13 is formed with at least two dovetail slots 33 inside of which are disposed sliding lugs 34 defining the housing 26 which is used for encasing each of studs 4 when the seal 6 is sufficiently compressed.

Figure 18:
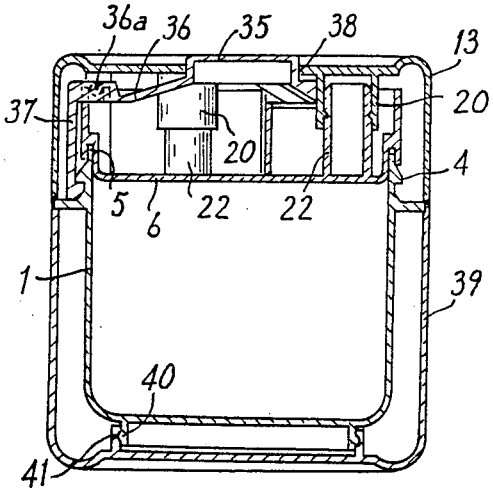
FIG. 18 is an elevation cross-section view of a further variant.

In FIG. 18, a push-piece 35 having arms 36 formed with lugs 37 encasing the studs 4 extends through the cap 13. The arms 36 bear, via a rigid portion 36*a*, on the top portion of the seal 6 while they are, themselves, flexible. By exerting pressure on the push-piece 35, the effect is to pivot the lugs 37 in order to disengage the lugs 37 from the studs 4. The push-piece 35 protrudes from the cap 13 via an opening 38 of the latter, and the cap 13 is connected to the seal 6 as explained with reference to FIG. 17, via the sockets 20 inside which the fingers 22 are nested and latched.

In this embodiment, it is advantageous that the body 1 is surrounded by an envelope 39 to which it is connected by snap-in rings.

What is claimed is:

1. A packing device, having a body, and comprising: a cap having the same shape as the body and closable in a tight manner on the body of the packing device; a cover provided inside the cap; a seal provided in the cover corresponding to a bearing surface of the body; lateral studs formed on said body cooperating with protruding bearing surfaces formed by lugs defined by the cap, whereby the seal is compressed onto the bearing surface when said protruding bearing surface cooperates with said studs.

2. A packing device, as set forth in claim 1, wherein the packing device, including the cap, has a substantially oval shape.

3. The packing device as set forth in claim 1, wherein the cover is mounted inside the cap by a snap-in engagement.

4. The packing device as set forth in claim 1, further comprising a tubular joining piece formed inside the cover; a tubular portion formed inside the cap which is received by the tubular joining piece and a mutual latching arrangement comprising a slot and retaining ring means for engagement with the slot; and wherein said tubular portion and the joining piece have a circular cross-section.

5. The packing device as set forth in claim 1, wherein the cover has a top portion provided with abutments forming guides and limiting angular displacement of said cap with respect to said cover to an angle for which the protruding bearing surfaces of the lugs are disengaged from the studs of the body.

6. The packing device as set forth in claim 1, wherein the cover comes to bear against an outer wall of the cap via a shoulder of said cap.

7. The packing device as set forth in claim 1. wherein the protruding bearing surfaces of the lugs and the studs form matching ramps in order to cause clamping of the seal of the bearing surface of the body.

8. The packing device as set forth in claim 1, comprising at least one latching protrusion provided between the protruding bearing surfaces and the cooperating studs.

9. The packing device as set forth in claim 1, wherein the body defines flat portions corresponding to lugs of the cap.

10. The packing device as set forth in claim 1, wherein the cap and the seal are formed as a unit and clamped by mobile lugs and arms carried by said cap.

11. The packing device as set forth in claim 1, comprising a sliding stirrup disposed inside an opening in the cap, said stirrup having arms each defining a snap-in groove for the studs of the body.

12. The packing device as set forth in claim 1, comprising a stirrup defining a pivoting axis in a cradle of the seal and in a corresponding notch of the cap covering said seal, the stirrup including pivoting arms formed with a snap-in groove for the corresponding stud of the body.

13. A packing device as set forth in claim 1, wherein the cap is partly cylindrical and is partially covered by a cylindrical sector from which are formed arms having pins extending at least through the cap, said arms cooperating with the studs of the body.

14. A packing device as set forth in claim 1, wherein the cap forms side lugs having an upper portion which is disposed opposite a housing and a lower portion which defines a snap-in groove for the studs of the body.

15. The packing device as set forth in claim 14, comprising a resilient element exerting a pressure on the upper portion of the lugs.

16. The packing device as set forth in claim 1, wherein the cap defines dovetail grooves for sliding lugs cooperating with the studs of the body.

17. The packing device as set forth in claim 1, comprising a push-piece connected by arms to lugs which can tip under action of a pressure exerted on the push-piece, a portion of the arms being rigid and bearing on top portion of the seal.

18. The packing device as set forth in claim 1, wherein the seal which directly bears on the bearing surface of the body is connected to the cap by means of fingers having retaining rings which are latched beyond collars formed by sockets of the cap.

* * * * *